United States Patent [19]

Becker

[11] Patent Number: 4,718,805

[45] Date of Patent: Jan. 12, 1988

[54] PIPE HANDLING APPARATUS

[76] Inventor: Floyd W. Becker, R.R. #9, Site 1, Box 15, Calgary, Alberta, Canada

[21] Appl. No.: 822,975

[22] Filed: Jan. 27, 1986

[30] Foreign Application Priority Data

Sep. 13, 1985 [CA] Canada ..... 490639

[51] Int. Cl.[4] ..... E21B 19/14

[52] U.S. Cl. ..... 414/22; 175/85; 414/735

[58] Field of Search ..... 414/22, 23, 590, 735, 414/745; 175/52, 85

[56] References Cited

U.S. PATENT DOCUMENTS

| | | | |
|---|---|---|---|
| 3,177,944 | 4/1965 | Knights | 414/22 X |
| 3,280,920 | 10/1966 | Scott | 414/22 X |
| 3,312,294 | 4/1967 | Wilson | 175/85 X |
| 3,750,769 | 8/1973 | Young et al. | 175/85 |
| 4,024,925 | 5/1977 | Brown | 175/85 |
| 4,172,684 | 10/1979 | Jenkins | 414/22 |
| 4,280,785 | 7/1981 | Albrecht | 414/23 X |
| 4,547,109 | 10/1985 | Young et al. | 414/22 |

FOREIGN PATENT DOCUMENTS

| | | | |
|---|---|---|---|
| 163563 | 9/1964 | U.S.S.R. | 175/85 |
| 773248 | 10/1980 | U.S.S.R. | 175/85 |
| 1016498 | 5/1983 | U.S.S.R. | 175/52 |

*Primary Examiner*—Leslie J. Paperner

*Attorney, Agent, or Firm*—William R. Hinds; George H. Dunsmuir

[57] ABSTRACT

Pipe handling systems are generally somewhat bulky, relying on a plurality of hydraulic cylinders and complicated linkages. A relatively simple, compact pipe handling apparatus for use on a derrick of the type which can be rotated between the horizontal and the vertical includes an elongated track for mounting on one side of the derrick, a carriage slidably mounted on the track, three swing arms connected end-to-end, the first arm being connected to a rotary actuator mounted on the carriage, rotation around an axis perpendicular to the longitudinal axis of the derrick, a second rotary actuator between the first and second swing arms for rotating the second and third swing arms around an axis parallel to and spaced apart from the longitudinal axis of the derrick, a third rotary actuator for rotating the third swing arm, which carries a pair of jaw assemblies. Thus, the apparatus can be used to grip a pipe section, move the pipe section up an inclined or vertical derrick, rotate the pipe section into a first position parallel to the longitudinal axis of the derrick and then into alignment with an existing pipe string in the center of the derrick, and lower the pipe section into engagement with the existing pipe string for attachment thereto using a conventional top drive.

6 Claims, 7 Drawing Figures

PIPE HANDLING APPARATUS

BACKGROUND OF THE INVENTION

This invention relates to a pipe section handling apparatus, and in particular to an apparatus for manipulating sections of a drill string.

Elongated lengths of pipe such as the sections of a drill string are inherently difficult to handle, primarily because of their length and weight. Consequently, systems for handling drill string sections are often complex and expensive to produce. Examples of racking devices or systems for handling drill string sections are described in Canadian Patents Nos. 728,020, issued to Dowty Rotol Limited on Feb. 15, 1966 and 1,151,143, issued to Chevron Research Company on Aug. 2, 1983, and U.S. Pat. No. 3,177,944 issued to Dowty Rotol Limited on Apr. 13, 1965.

The object of the present invention is to overcome the problems mentioned above by providing a relatively simple, compact apparatus for handling pipe sections.

SUMMARY OF THE INVENTION

Accordingly, the present invention relates to a pipe handling apparatus for mounting on a derrick of the type including drive means for rotating the derrick between the horizontal and vertical positions, said apparatus comprising track means on one side of said derrick extending longitudinally thereof; carriage means slidable on said track means; drive means for moving said carriage means along said track means; first swing arm means pivotally connected to said carriage means for rotation around a first axis perpendicular to the longitudinal axis of said derrick means; first actuator means for rotating said first swing arm means around said first axis; second swing arm means pivotally connected to the outer free end of said first swing arm means for rotation around a second axis parallel to the longitudinal axis of the derrick; second actuator means for rotating said second swing arm means around said second axis; third swing arm means pivotally connected to the outer free end of said second swing arm means for rotation around a third axis perpendicular to the longitudinal axis of said derrick and perpendicular to said first and second axes; third actuator means for rotating said third swing arm means around said third axis; and jaw means on said third swing arm means for gripping a pipe section, whereby the pipe section can be gripped in a horizontal position, moved upwardly along said track means with said carriage, rotated with said first swing arm means to a position in which said first swing arm means is parallel to said derrick, rotated with said third swing arm means to a position parallel to a said derrick, rotated with said second swing arm means into alignment with an existing pipe string in the center of said derrick, and moved downwardly with said carriage so that said pipe section engages the existing pipe string.

BRIEF DESCRIPTION OF THE DRAWING

The invention will now be described in greater detail with reference to the accompanying drawings, which illustrate a preferred embodiment of the invention, and wherein.

DESCRIPTION OF THE PREFERRED EMBODIMENT(S)

Figure 1:
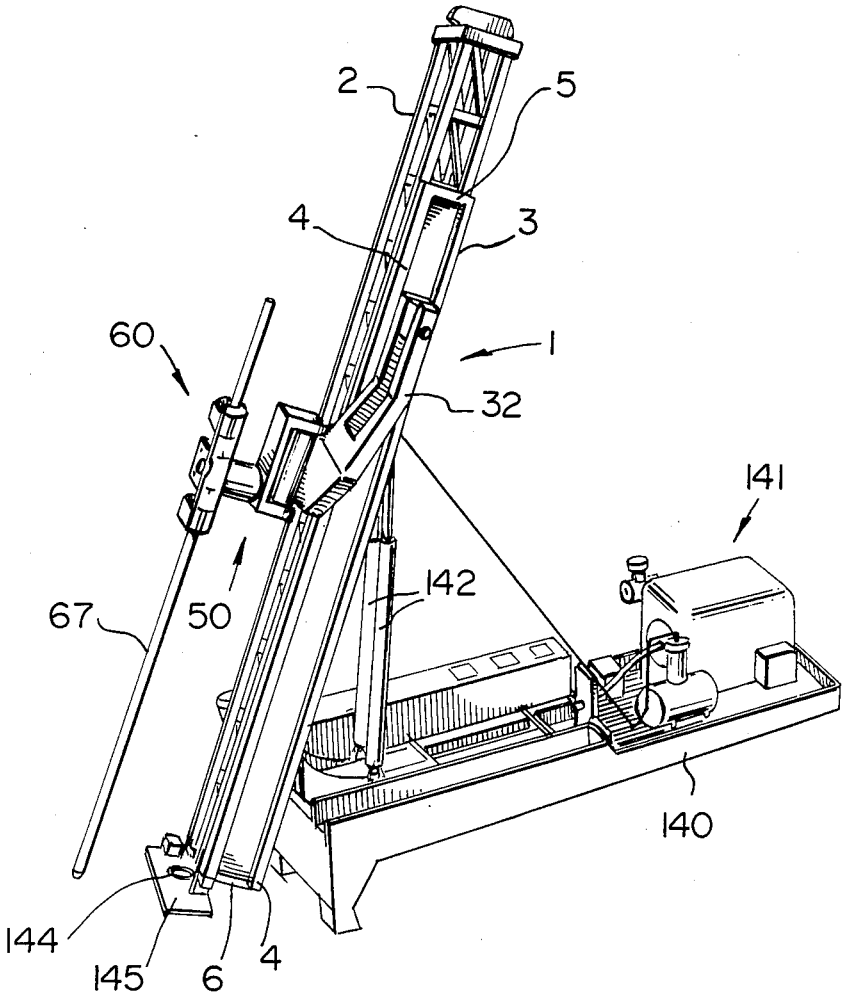
FIG. 1 is a schematic perspective view of the apparatus of the present invention mounted on a drilling rig.

With reference to FIG. 1, the apparatus of the present invention which is generally indicated at 1, is intended for use on a derrick defined by an elongated, rectangular, skeletal frame 2. A second frame 3 including a pair of elongated tracks 4, is mounted on one side of the frame 2 for carrying the apparatus 1. The frame 3 has closed top and bottom ends 5 and 6, respectively, for limiting movement of the apparatus.

Figure 2A:
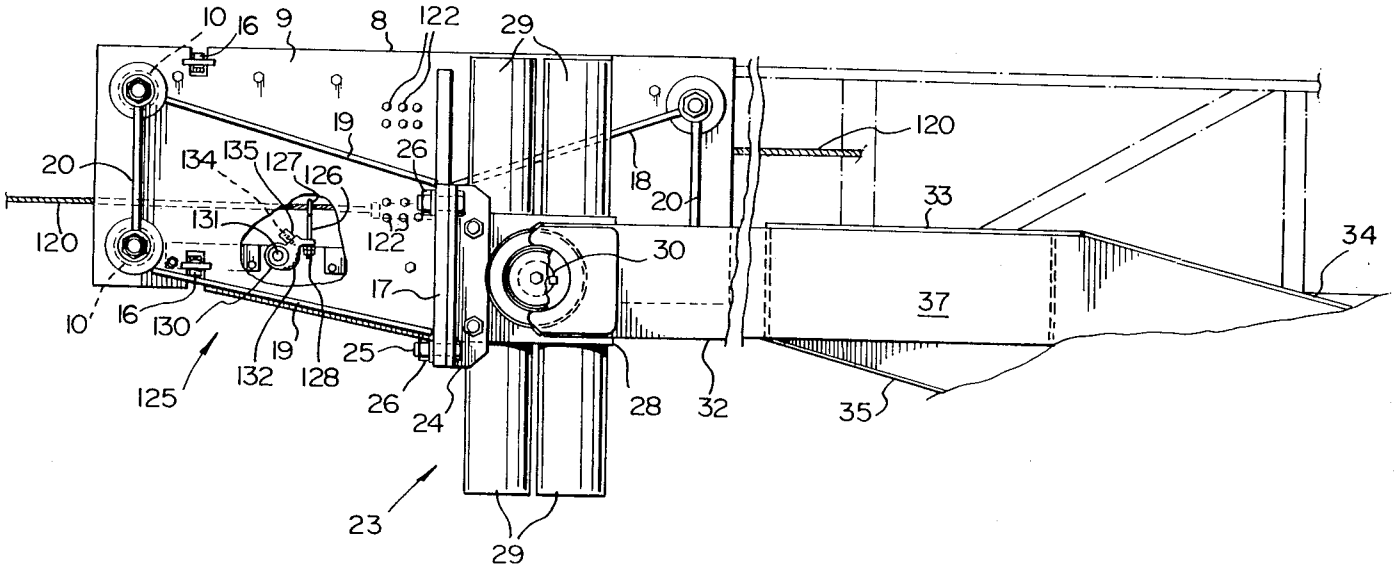
FIG. 2, which includes FIGS. 2A and 2B on separate sheets, is a partly sectioned, side elevation view of the apparatus of FIG. 1.
Figure 2B:
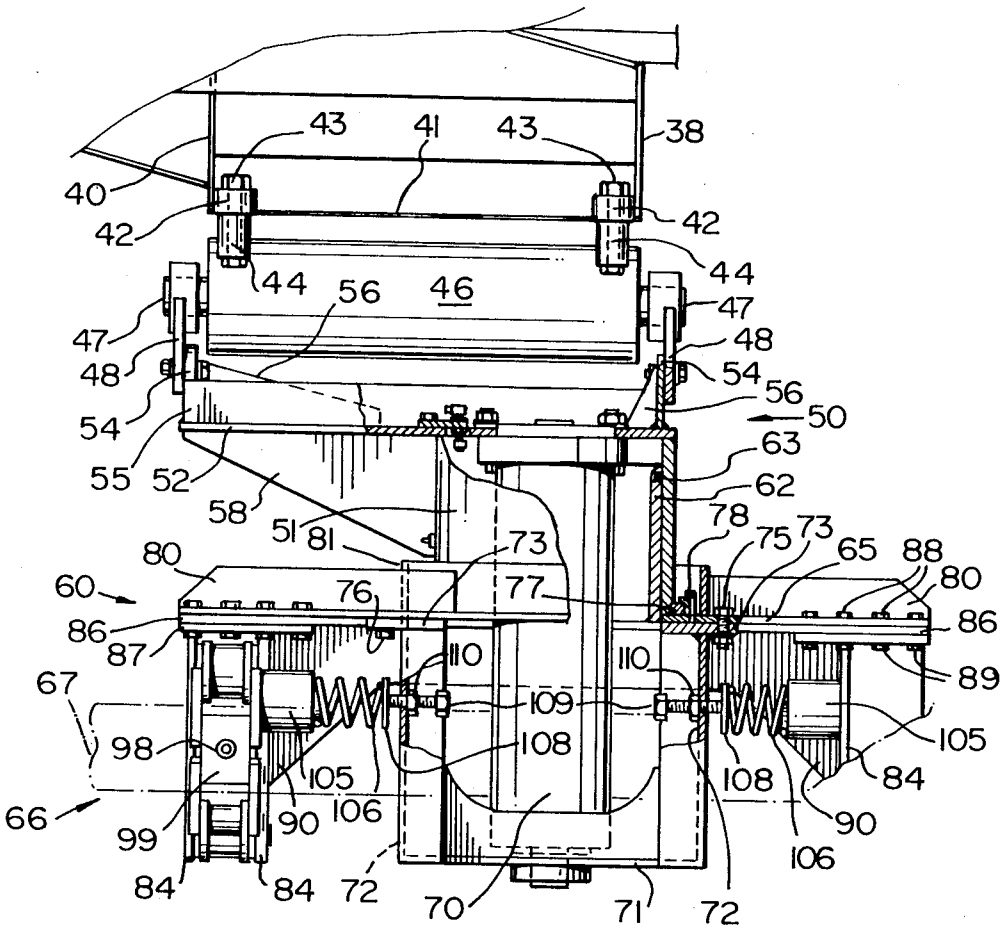

As best shown in FIG. 2, one of the principal elements of the apparatus 1 is a carriage 8 slidably mounted on the frame 3. The carriage 8 is defined by a generally rectangular sheet 9 of metal carrying a flanged roller 10 near each corner thereof for rolling on the top and bottom opposed tracks 4 in the frame 3. The rollers 10 are mounted on bearings 11 and bolts 12 extending through circular hubs 13 mounted over openings 14 in the plate 9. Thus, the plate 9 is quite close to the side of the frame 3, sliding against one side thereof. The carriage 8 is maintained on the frame 3 by pairs of rollers 16 which engage the tracks 4 between the rollers 10.

A plate 17 extends outwardly from the sheet 9 at a right angle thereto. Reinforcing gussets 18 and 19 extend between the sheet 9 and the plate 17, so that the plate 17 can support the remainder of the apparatus, which in effect, is cantilevered to such plate. Reinforcing ribs 20 also extend across the ends of the sheet 9 between the rollers 10.

A first rotary actuator generally indicated at 23 is connected to the plate 17 by brackets 24 of L-shaped cross section, bolts 25 and nuts 26. The rotary actuator 23 includes a block or casing 28 connected to the plate 17 by the brackets 24, and cylinders 29 for rotating a shaft 30. A bifurcated swing arm 32 extends outwardly from the outer ends of the shaft 30 for rotation herewith around the longitudinal axis of the shaft. The outer end of the arm 32 is covered by top plates 33 and 34, bottom plate 35, side plates 37 and an end plate 38.

The end plate 38 and a second end plate 40 extends downwardly to a base plate 41. Transversely extending blocks 42 are mounted between the ends of the base plate 41 and the end plates 38 and 40 for receiving bolts 43. The bolts 43 extend through mounting blocks 44 on the ends of a second rotary actuator 46. The shaft 47 of the rotary actuator 46 extends outwardly beyond each end thereof. A mounting plate 48 is mounted on each end of the shaft 47 for carrying a second swing arm generally indicated at 50. The second swing arm 50 includes a cylindrical sleeve 51 mounted on one end of a plate 52. The plate 52 is connected to the plate 48 by flanges 54 extending outwardly from the ends of the plate 52. Reinforcing strips 55 are provided on each side of the plate 52 extending between the flange 54, and gussets 56 extend between the centers of the flanges 54 and the plate 52. Additional gussets 58 extend between the plate 52 and the sleeve 51.

Figure 4:
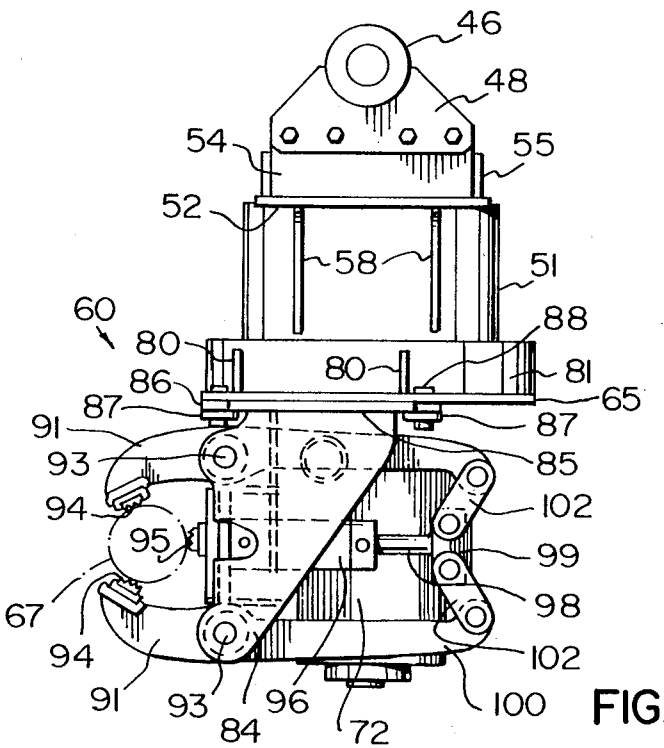
FIG. 4 is an end elevation of the outer end of the apparatus of FIGS. 1 through 3, as seen from the left of FIG. 2.

A third swing arm generally indicated at 60 is rotatably connected to the sleeve 51 for rotation around an axis perpendicular to the longitudinal axis of the shaft 47 of the rotary actuator 46. The third swing arm 60 includes a cylinder 62 rotatably mounted in the sleeve 51. An O-ring 63 forms a seal between the top end of the cylinder 62 and the sleeve 51. The cylinder 62 is connected to a rectangular plate 65 which forms part of a jaw mechanism generally indicated at 66 for gripping a pipe section 67 (FIGS. 2 and 4). The plate 65 includes a central circular opening for a third rotary actuator 70, one end of which is connected to the plate 52 and the other end of which is connected to a rectangular plate 71. End plates 72 extend outwardly from crossbars 73 attached to the plate 65. The crossbars 73 are connected to the plate 65 at each end of the openings 68 by bolts 75 and nuts 76. The spacing between the top of the cylinder 62 and the sleeve 51 is maintained by an annular flange 77 extending outwardly from the bottom end of the sleeve 51, and an inverted L-shaped ring 78 (one shown) which is bolted to the plate 65. Reinforcing strips 80 are provided on the plate 65 extending between the ends thereof and an annular wall 81 welded to the plate 65 at the bottom end of the sleeve 51.

Parallel, spaced apart, generally triangular arms 84 extend outwardly from each end of a plate 85 on one side of the plate 65. The plate 85 is longitudinally slidable relative to the plate 65. For such purpose, spacers 86 and strips 87 are mounted on the plate 65 means of bolts 88 and nuts 89 to define tracks for the plate 85. A reinforcing plate with generally triangular ends 90 (FIG. 2) extends outwardly from the plate 85 between the opposed inner arms 84 of the jaw mechanism 60. A pair of elongated, arcuate jaws 91 are pivotally mounted between each pair of arms 84 at spaced apart locations for rotation around axles 93 between open and closed positions. Teeth 94 for gripping a pipe section 67 are mounted on the outer ends of the jaws 91. Fixed central teeth 95 are mounted on a plate which also supports one end of a hydraulic cylinder 96 between the ends of the jaws 91. A piston rod 98 extends out of the other end of the cylinder 96 to a block 99 between the inner ends 100 of the jaws 91. Short levers or toggles 102 are pivotally connected to the inner ends 100 of the jaws 91 and to the block 99. Thus, extension of the piston rod 98 causes the inner ends 102 of the jaws 91 to move apart, closing the jaws, and retraction of the piston rod 98 reverses the process.

Shock absorbers (FIG. 2) extend between the inner arms 84 and the plate 72. The shock absorbers are defined by short sleeves 105 mounted on the inner arms 84 and helical springs 106 slidable in such sleeves 105. The springs 106 are connected to circular heads 108, which are mounted on the ends of bolts 72, so that the tension on the springs 106 can be adjusted.

Figure 3:
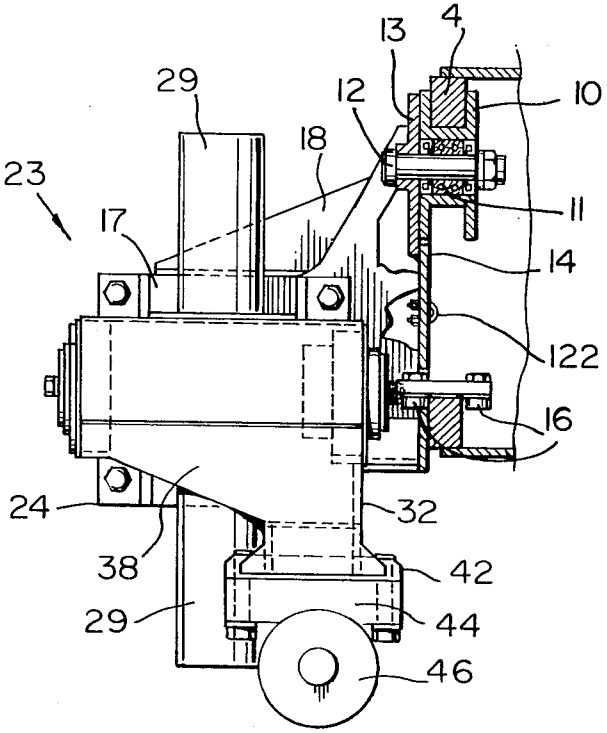
FIG. 3 is a partly-sectioned end elevation view of the apparatus of FIGS. 1 and 2, as seen from the right of FIG. 2, with parts omitted.
Figure 5:
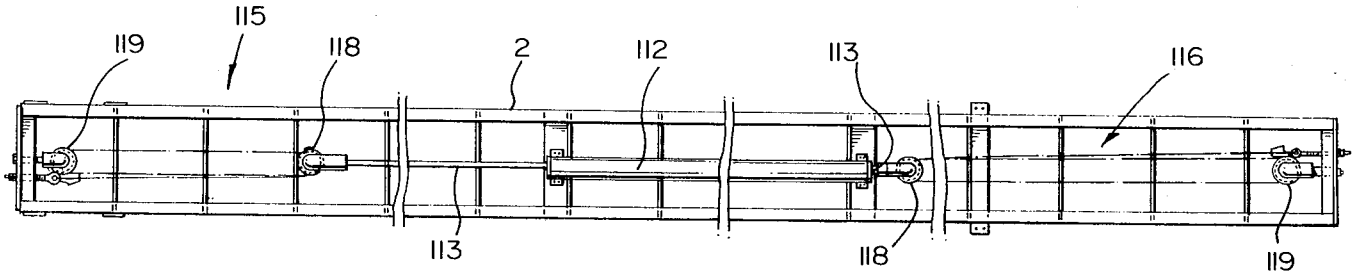
FIG. 5 is a schematic plan view of a derrick and drive system for use with the apparatus of FIGS. 1 through 4.
Figure 6:
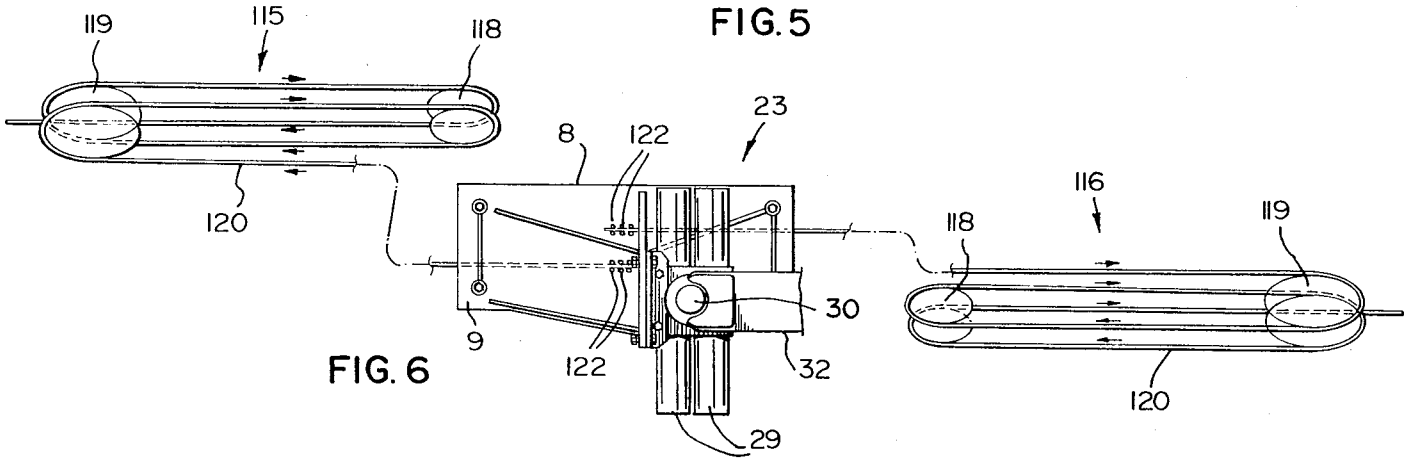
FIG. 6 is a schematic exploded view of the drive system of FIG. 5.

Referring to FIGS. 5 and 6, the carriage 8 is caused to move along the tracks 4 by a double-acting hydraulic cylinder 112, the piston rods 113 of which are connected to upper and lower pulley systems generally indicated at 115 and 116, respectively. The cylinder 112 is fixedly mounted on the frame 3. Each pulley system 115 and 116 includes double travelling and stationary sheaves 118 and 119, respectively, and a cable 120. The cable 120 is connected at one end to one end of the frame 3, and and at the other end to the sheet 9 of the carriage 8 by U-bolts 122 (FIGS. 2 and 3). The stationary sheave 119 of the upper pulley system 115 is connected to the top end of the frame 3, and the stationary sheave 119 of the lower pulley system 116 is connected to the bottom end of the frame 3. The travelling sheave 118 of the upper pulley system 115 and the travelling sheave 118 of the lower pulley system 116 are connected to the opposite outer ends of piston rods 113 of the cylinder 112. Thus, the carriage 8 and consequently virtually the entire apparatus can readily be moved longitudinally with respect to the frame 3.

With reference to FIG. 2, a brake generally indicated at 125 is provided on the sheet 9 of the carriage 8. The brake 125 includes an eye hook 126, the loop end 127 of which extends around the cable 120 of the upper pulley system 115. The other threaded end 128 of the hook 125 is connected to a small lever 130. The lever 130 is rotatably mounted on a stub axle 131, and the hub thereof includes a serrated edge 132 for engaging the track 4. A helical compression spring 134 extends between a recess in the lever 130 and a similar recess in a lug 135 welded to the sheet 9. Thus, if the cable 120 breaks, the spring 134 pushes the lever 130 outwardly so that the serrated edge 132 of the lever engages the track 4 to slow or stop the carriage 8.

Referring again to FIG. 1, in use the derrick frame 2 is mounted on a drill deck 140 carrying pumps and related equipment generally indicated at 141. The frame 2 is moved, i.e. raised and lowered using hydraulic cylinders 142.

During use of the apparatus, the derrick mast or frame 2 normally remains in the vertical or an inclined position, depending upon drilling conditions. When adding pipe from horizontal storage beside the frame 2 to an existing string, the carriage 8 is lowered so that the jaws 91 are located beneath the level of the stored pipe sections 67. Thus, the pipe sections 67 can be rolled into the open jaws 91, the jaws are closed and the carriage 8 is moved up the frame 2 to the desired location. Using rotary actuator 23, the arm 32 is rotated to a position parallel to the track 4. The third rotary actuator 70 rotates the arm 60 to a positive stop so that the pipe section 67 is also parallel to the track 4. The actuator 46 then rotates the second swing arm 50 to align the pipe section 67 with the existing pipe string in the center of the frame 2 (FIGS. 1 and **2*b***).

The carriage 8 is then lowered so that the threads in the drill stem are engaged by the threads of the new pipe section 67. The top drive (not shown) is then lowered to engage the top end of the pipe section 67, and the jaws 91 are opened to disengage the apparatus from the pipe section 67. The top drive is used to attach the new section 67 to the pipe strings. The swing arm 60 is rotated out of the frame 2 by means of the rotary actuator 46, and the carriage 8 is again lowered to pick up a new section of pipe.

During connection to a drill string, the pipe section 67 is still loosely retained in a vertical position by the jaws 91, and consequently the jaws may be jarred. The springs 106 of the shock absorbers reduce the likelihood of damage to the jaw mechanism 66, and to the threads in the pipe section 67. Moreover, the springs 106 permit travel of the arms 84 relative to the plates 72, and thus, when the jaws 91 are closed, function as a slide for the make up or unthreading of pipe sections 67. Otherwise, it would be necessary to move the entire carriage assembly up or down the track.

What I claim is:

1. A pipe handling apparatus for mounting on a derrick of the type including drive means for rotating the derrick between the horizontal and vertical positions, said apparatus comprising track means on one side of said derrick extending longitudinally thereof; carriage means slidable on said track means; drive means for moving said carriage means along said track means; first swing arm means pivotally connected to said carriage means for rotation around a first axis perpendicular to the longitudinal axis of said derrick means; first actuator means for rotating said first swing arm means around said first axis; second swing arm means pivotally connected to the outer free end of said first swing arm means for rotation around a second axis generally normal to said first axis and generally parallel to the longitudinal axis of the derrick when said first swing arm is generally parallel to the longitudinal axis of the derrick; second actuator means for rotating said second swing arm means around said second axis; third swing arm means pivotally connected to the outer free end of said second swing arm means for rotation around a third axis perpendicular to the longitudinal axis of said derrick and perpendicular to said first and second axes; third actuator means for rotating said third swing arm means around said third axis; and jaw means on said third swing arm means for gripping a pipe section, whereby the pipe section can be gripped in a horizontal position, moved upwardly along said track means with said carriage, rotated with said first swing arm means to a position in which said first swing arm means is parallel to said derrick, rotated with said third swing arm means to a position parallel to a said derrick, rotated with said second swing arm means into alignment with an existing pipe string in the center of said derrick, and moved downwardly with said carriage so that said pipe section engages the existing pipe string.

2. An apparatus according to claim 1, wherein said drive means includes fluid actuated cylinder means, sheave means connected to said cylinder means and to at least one end of the derrick and cable means extending around said sheave means connected at one end to said one end of the derrick and at the other end to said carriage means.

3. An apparatus according to claim 1, wherein said first actuator means is a first rotary actuator extending outwardly from said carriage means for pivotally supporting one end of said first swing arm means, whereby said first swing arm means is parallel to the longitudinal axis of said derrick, said second actuator means is a second rotary actuator connected to the outer end of said first swing arm means for pivotally supporting said second swing arm means; and said third actuator means is a third rotary actuator connected to the outer end of said second swing arm means for pivotally supporting said third swing arm means.

4. An apparatus according to claim 1, wherein said jaw means includes a pair of spaced apart jaws for gripping a pipe section at spaced apart locations.

5. An apparatus according to claim 4, wherein said jaw means includes shock absorber means between said pair of jaws for protecting the jaw means during connection of one pipe section to another pipe section.

6. An apparatus according to claim 1 wherein said track means comprises tracks extending in a common plane along one side of said derrick, and said first arm swings in a plane generally parallel to the plane of said tracks.

* * * * *